United States Patent [19]

Zolnerovich, Jr. et al.

[11] 4,134,476

[45] Jan. 16, 1979

[54] ELEVATOR SYSTEM

[75] Inventors: Walter Zolnerovich, Jr., Newark, Ohio; William N. C. Leang, Waukesha, Wis.

[73] Assignee: Westinghouse Electric Corp., Pittsburgh, Pa.

[21] Appl. No.: 845,520

[22] Filed: Oct. 26, 1977

[51] Int. Cl.[2] ..... B66B 3/02

[52] U.S. Cl. ..... 187/29 R; 340/21

[58] Field of Search ..... 340/19, 21; 187/29

[56] References Cited

U.S. PATENT DOCUMENTS

| | | | |
|---|---|---|---|
| 3,592,296 | 7/1971 | Senn | 187/29 |
| 3,750,850 | 8/1973 | Winkler et al. | 187/29 |
| 3,773,146 | 11/1973 | Dixon, Jr. et al. | 187/29 |
| 3,889,231 | 6/1975 | Tosato et al. | 187/29 X |
| 3,963,098 | 6/1976 | Lewis et al. | 187/29 |
| 4,019,606 | 4/1977 | Caputo et al. | 187/29 |
| 4,083,430 | 4/1978 | Gingrich | 187/29 |

*Primary Examiner*—Robert K. Schaefer
*Assistant Examiner*—W. E. Duncanson, Jr.
*Attorney, Agent, or Firm*—D. R. Lackey

[57] ABSTRACT

An elevator system including an elevator car mounted in the hoistway of a building having a plurality of floors, hoistway doors at the floors, and a floor selector for controlling the movement of the elevator car. Each hoistway door includes address indicia related to the address of its associated floor in the building. A detector on the elevator car reads the indicia during movement of the hoistway door. The address read from the hoistway door is loaded into a car position memory associated with the floor selector.

7 Claims, 4 Drawing Figures

ELEVATOR SYSTEM

BACKGROUND OF THE INVENTION

1. Field of the Invention

The invention relates in general to elevator systems, and more specifically to elevator systems which utilize a solid state car position memory.

2. Description of the Prior Art

The operation of an elevator car is controlled by its floor selector. The floor selector keeps track of car position, and it directs the car to the correct floor to serve a call for elevator service. Certain prior art floor selectors have utilized an electromechanical device which is a scaled down version of the associated elevator system. The electromechanical device is driven in synchronism with its associated elevator car. While the electromechanical floor selector provides good results, it is costly to manufacture, and it requires considerable skill to initially set up and adjust, especially in high speed elevator systems. Also, since it is mechanical in nature, it requires periodic maintenance to keep it in proper operating condition. Thus, the trend is to replace the electromechanical floor selector with a solid state floor selector, which is more accurate, easier to install, and easier to maintain.

The solid state floor selector has many advantages over the prior art electromechanical floor selector, but it does have a disadvantage not found in the electromechanical selector. The solid state selector stores car position in a volatile memory, such as a binary counter. Loss of electrical power causes the selector to lose track of the car, and when power returns, the selector must be reset. In the solid state floor selector described in U.S. Pat. No. 3,750,850, which is assigned to the same assignee as the present application, the reset procedure involves sending the elevator car to a terminal floor, where the floor address of the terminal floor is loaded into the car position counter.

Copending application Ser. No. 775,808, filed Mar. 9, 1977 entitled "Elevator System", which application is assigned to the same assignee as the present application, sets forth a solution to the power outage problem, which solution includes the use of capacitors to store electrical energy sufficient to power the car movement detector following a power outage. Car movement following a power outage is detected and stored. When power returns, a stored indication of car movement is used to correct the car position device.

Many prior art arrangements have utilized a coded tape in the hoistway which is read by readers on the car. An improved arrangement of this type is disclosed in U.S. Pat. No. 3,963,098 which is assigned to the same assignee as the present application. In the arrangement of this patent, a digital code having a non-repeating bit pattern over any N consecutive bits is utilized. Thus, car position can be determined without moving the car if N readers are utilized; or, as described in a preferred embodiment, only four readers will determine the car position after the car has moved only N bits, which typically may be a foot, or less.

In U.S. Pat. No. 3,592,296, magnetic switches and vanes are arranged to provide a digital code to identify each floor and correct a notching type floor selector, if it is found to be out of step.

While the hereinbefore described arrangements all provide excellent results, it would be desirable to be able to determine the car position when electrical power is applied to the control circuits, such as upon start-up, and after return of electrical power following a power outage, without moving the car from a floor, or by simply moving the car to the closest floor if the car is not already at a floor when power returns. Further, it would be desirable to do this without requiring the use of a coded tape in the hoistway, and without requiring as many readers as bits in the floor address.

SUMMARY OF THE INVENTION

Briefly, the present invention is a new and improved elevator system which utilizes the rectilinear movement of the hoistway door to reduce the number of code readers required to identify car location. A card having the binary address of the associated floor is attached to each hoistway door. A reader on the car reads the code upon a predetermined movement of the door, such as the closing movement. The reader reads and stores the code bits as they are "scanned" past the reader by the predetermined door movement. Thus, initialization and reset procedure simply involves sending the car to the closest floor at landing speed, if it is not already at a floor, and to operate the car and hoistway doors to read the coded card associated with that floor.

In addition to resetting the selector during start-up, and following the return of power after a power outage, the selector may be automatically reset at each floor during normal operation of the elevator system, to insure that the selector is always in step with the actual car position.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF PREFERRED EMBODIMENTS

Figure 1:
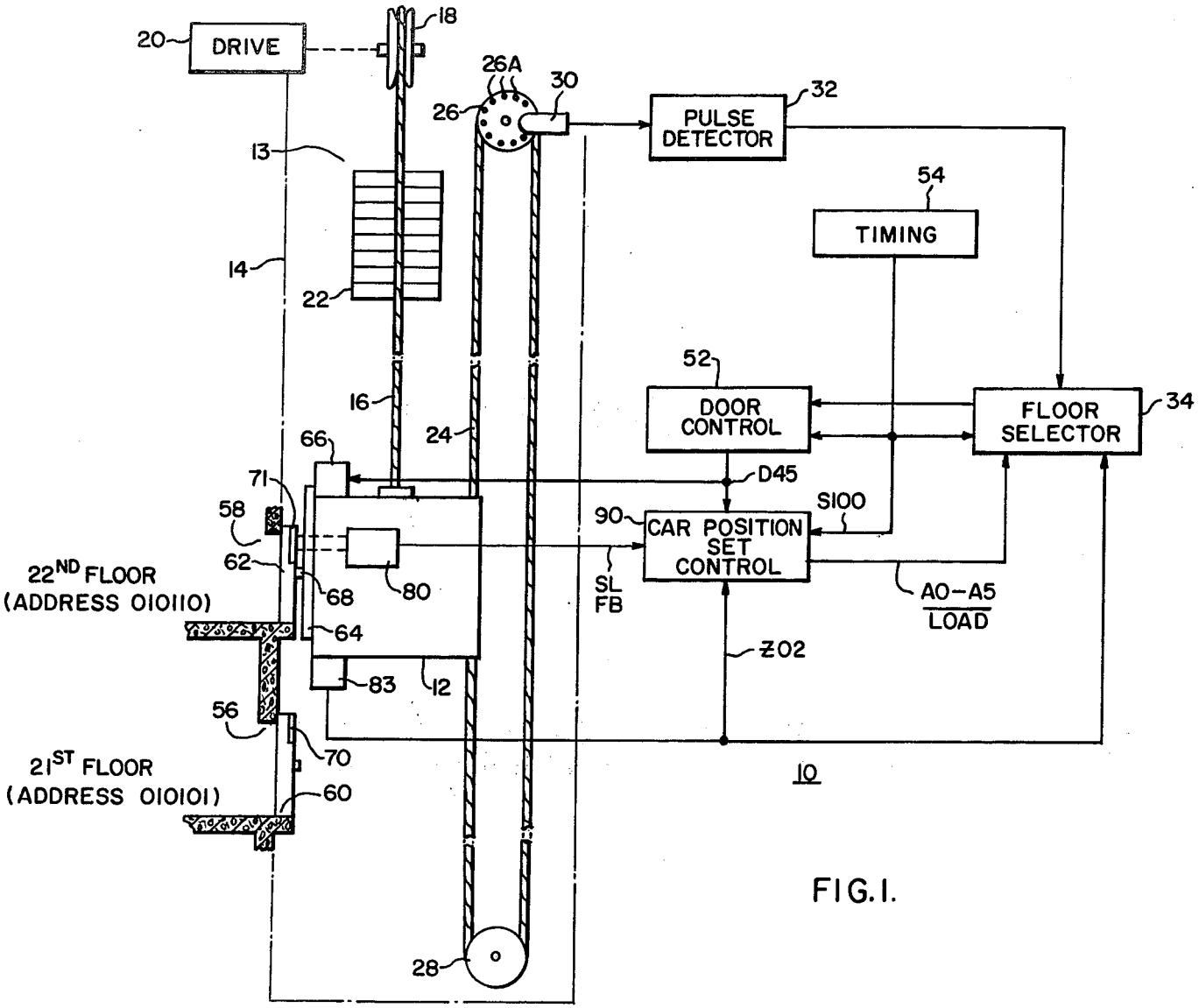
FIG. 1 is a partially schematic and partially block diagram of an elevator system constructed according to the teachings of the invention.

Referring now to the drawings, and to FIG. 1 in particular, there is shown an elevator system 10 constructed according to the teachings of the invention. In order to reduce the complexity of the present application, the elevator system disclosed in U.S. Pat. No. 3,750,850, which is assigned to the same assignee as the present application, is hereby incorporated into the present application by reference.

Elevator system 10 includes an elevator car 12 mounted in a hoistway 13 for movement relative to a structure or building 14 having a plurality of floors, with only the 21st and 22nd floors being shown in order to simplify the drawing. The elevator car 12 is supported by wire ropes 16 which are reeved over a traction sheave 18 mounted on the shaft of a drive motor 20.

A counterweight 22 is connected to the other ends of the ropes 16. A governor rope 24 which is connected to the car 12, is reeved over a governor sheave 26 located above the highest point of travel of the car 12 in the hoistway 13, and over a pulley 28 located at the bottom of the hoistway. A pickup 30 is disposed to detect movement of the car 12 through the effect of circumferentially spaced openings 26a in the governor sheave 26. The openings in the governor sheave are spaced to provide a pulse for each standard increment of travel of the car, such as a pulse for each 0.5 inch of car travel. Pickup 30, which may be of any suitable type, such as optical or magnetic, provides pulses in response to the movement of the openings 26a in the governor sheave. Pickup 30 is connected to a pulse detector 32 which provides distance pulses for a floor selector 34. Distance pulses may be developed in any other suitable manner, such as by a pickup disposed on the car which cooperates with regularly spaced indicia in the hoistway.

The floor selector 34 processes the distance pulses from the pulse detector 32 to develop information concerning the position of the car 12 in the hoistway 13, and it also directs these processed distance pulses to a speed pattern generator (not shown) which generates a speed reference signal for a motor controller (not shown) which in turn provides the drive voltage for motor 20.

The floor selector 34 keeps track of the elevator car 12, the calls for service for the car, it provides the request to accelerate signals to the speed pattern generator, and it provides the deceleration signal for the speed pattern generator at the precise time required for the car to decelerate according to a predetermined deceleration pattern and stop at a predetermined floor for which a call for service has been registered. The floor selector 34 also provides signals for controlling such auxiliary devices as the door control 52, the hall lanterns (not shown), and it controls the resetting of the car and hall calls when a car or hall call has been serviced.

Timing circuitry 54 provides system timing signals for synchronizing the various control functions of the elevator system 10.

The building 14 includes an opening at each floor to the hoistway 13, such as openings 56 and 58 at floors 21 and 23, respectively. These openings are normally closed by the hoistway doors mounted for rectilinear motion, such as hoistway doors 60 and 62 at floors 21 and 22, respectively.

The elevator car 12 includes one or more car doors 64 mounted for rectilinear motion to open and close the entrance to the passenger compartment of the elevator car. The doors 64 are controlled by a door operator 66 mounted on top of the car, which in turn is controlled by door control 52 and the floor selector 34.

The car doors 64 unlock the associated hoistway doors when the elevator car stops at a floor, and the driving power for operating the hoistway doors is provided via a mechanical link (drive vane and block), shown generally at 68.

Each of the floors of the building 14 has a binary address, i.e., 010101 for the 21st floor, 010110 for the 22nd floor, etc. According to the teachings of the invention, a code card containing the floor address code is mounted on each hoistway door for movement therewith, such as card 70 mounted on hoistway door 60, and card 71 mounted on hoistway door 62. A card reader 80 is mounted on the elevator car 12. The card reader 80 provides signals SL and FB, which will be hereinafter explained.

A landing zone detector 83 on the elevator car 12 cooperates with a suitable plate assembly (not shown) mounted in the hoistway, one for each floor, which combination provides a speed pattern for accurately landing the car, as well as signals which indicate the location of the car relative to the floor level. Signals are commonly provided when the elevator car is within 10 inches, 2 inches, and 0.25 inch, of the floor level.

A car position reset control 90 constructed according to the teachings of the invention is responsive to the signals SL and FB provided by the reader 80. Control 90 is additionally responsive to a car position signal from the landing zone detector 82, such as a signal ZO2 which is at the logic one level when the elevator car is within 2 inches of the landing at which it is going to stop, a door command signal from door control 52, such as a signal D45 which goes to the logic one level when the car doors are to close, and also to a signal from system timing 54, such as a timing signal S100. In response to these input signals, control 90 provides the binary address of the floor at which it is located in the form of a binary signal A0–A5, and a signal $\overline{\text{LOAD}}$ which goes to the logic one level when valid data is ready. The floor address A0–A5 and the data ready signal $\overline{\text{LOAD}}$ are sent to the floor selector 34. It should be noted that the binary floor address signal A0–A5 may have fewer, or more than six bits, with six bits being selected for purposes of example as it will provide addresses for up to 64 floors.

Figure 2:
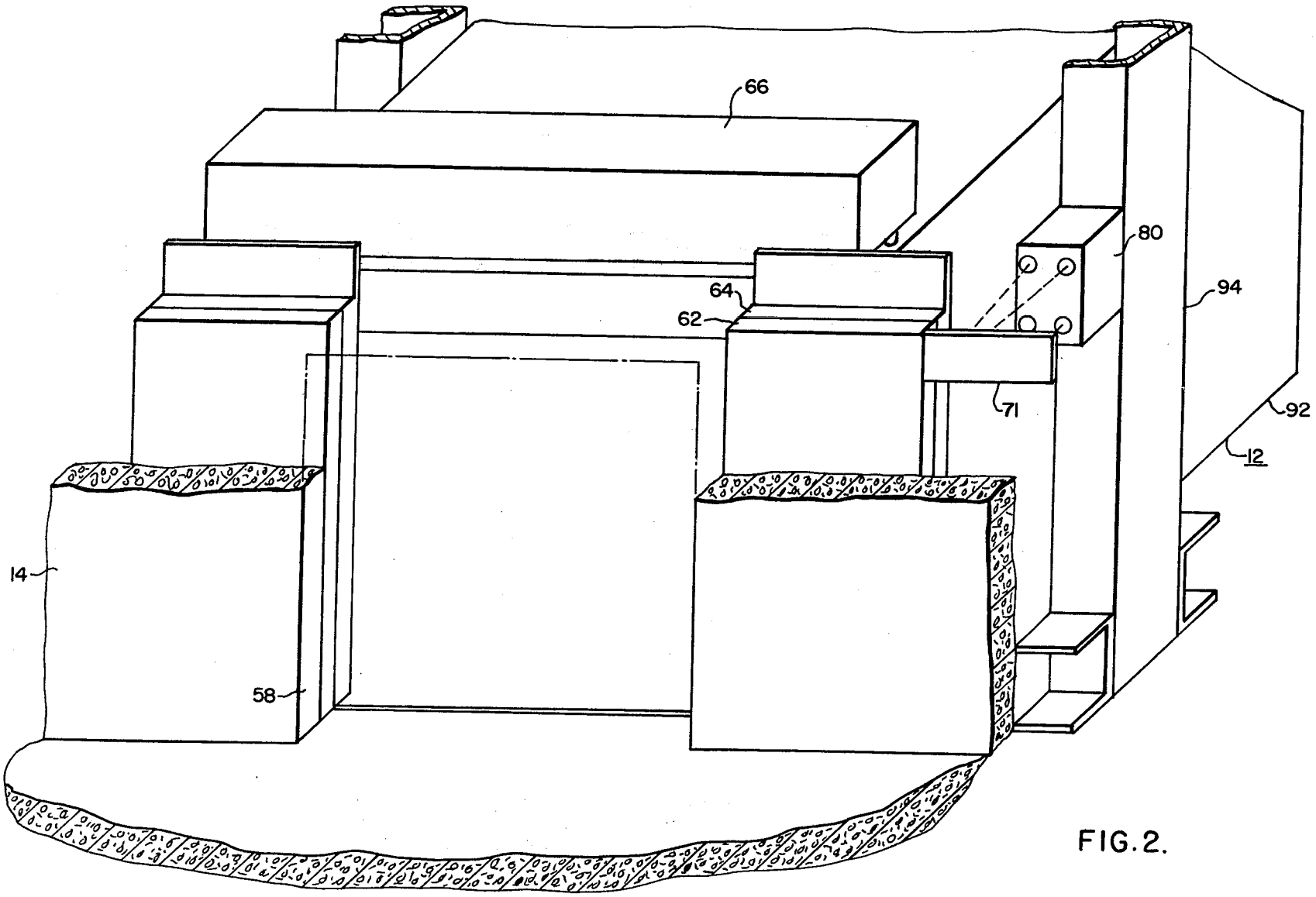
FIG. 2 is a perspective view of the elevator system shown in FIG. 1, shown partially cut away in order to more clearly illustrate the teachings of the invention.

FIG. 2 is a perspective view of the elevator car 12 standing at the 22nd floor with its doors 64 open. The elevator car 12 is shown in greater detail in FIG. 2, with FIG. 2 illustrating an elevator cab 92 supported by a cab sling 94. The reader 80 is illustrated mounted on the sling 94, but any convenient mounting location may be used.

Figure 3:
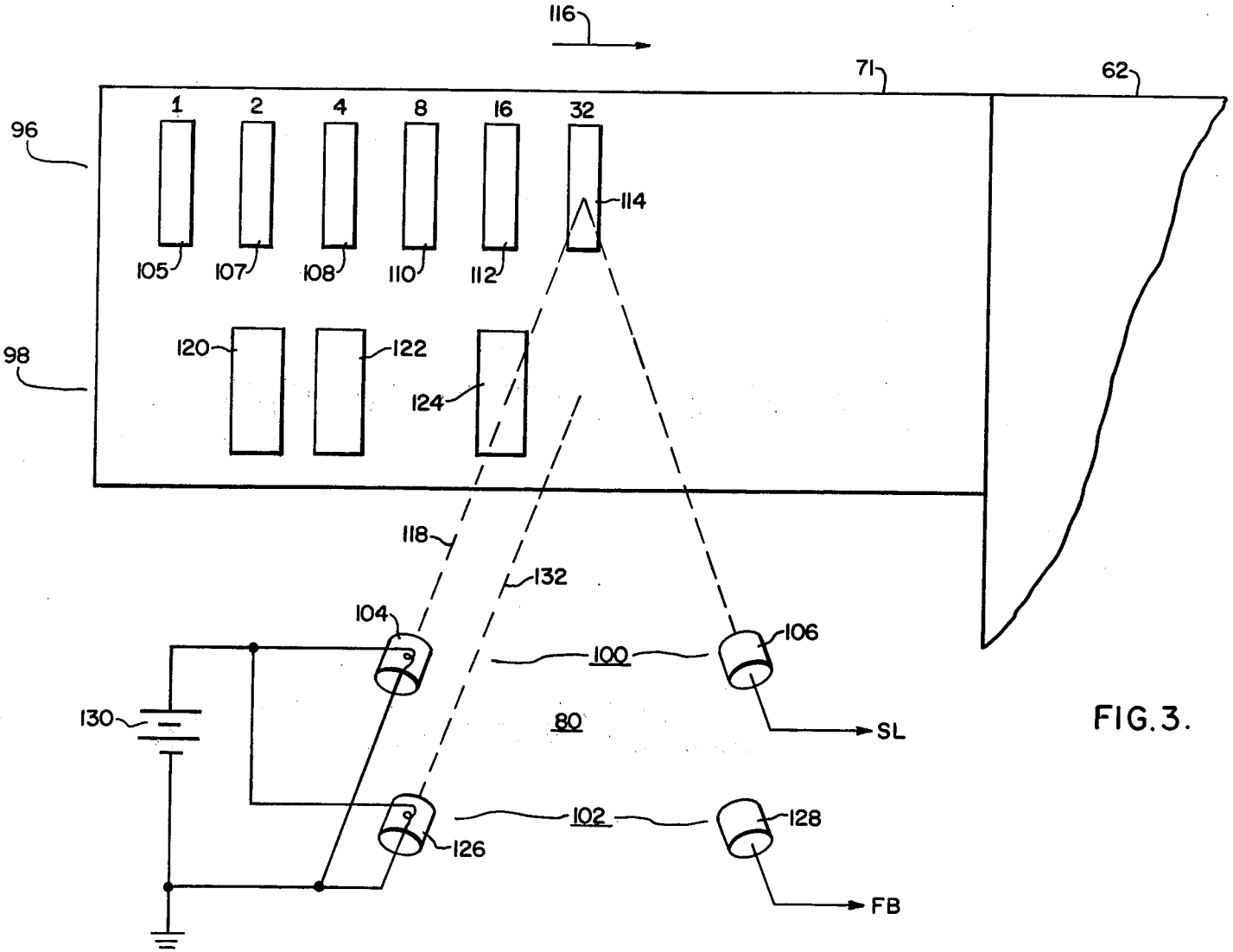
FIG. 3 is an elevational view of the coded card attached to each hoistway door of the elevator system shown in FIGS. 1 and 2, and a schematic representation of the card reader.

FIG. 3 is an elevational view of coded card 72, as viewed from the reader side. A schematic representation of the reader 80 is also illustrated. The coded card 72 includes two rows of indicia, a first row 96 which is used to provide strobe pulses to indicate when a bit position of the floor address should be read, and a second row 98 which sets forth the floor address code. For purposes of example, it will be assumed that the coded card 72 is read upon door closure. It could also be arranged to read the card when the door is opening, if desired.

A first detector 100 is arranged to detect the indicia of the first row 96, and a second detector 102 is arranged to detect indicia of the second row 98. Detector 100 includes a source 104 of electromagnetic radiation, and a receiver 106 thereof, such as a photoelectric transmitter, and a light detector, respectively. Card 72 may be formed of non-light reflective material, with the indicia being formed of light reflective material. Thus, if six bits are used to provide the floor address code, six strips 104, 106, 108, 110, 112 and 114 of reflective tape are provided which indicate when the six bits of the floor address should be read. Strip 104 is associated with the least significant bit (LSB) and strip 114 is associated with the MSB. As the hoistway door 62 closes in the direction of arrow 116, a beam of light 118 from the transmitter 104 will strike the reflector 114 and the beam will be reflected to the receiver 106 which provides a true or logic one signal SL. Signal SL will drop to the logic zero level when the beam 118 strikes the non-reflective surface located between the reflectors 114 and 112, and signal SL will return to the logic one level as the beam strikes reflector 112 and is directed to receiver 106, etc.

The second row 98 of indicia includes a reflective strip at each bit location which is to indicate a logic one signal. The locations of the logic zero signals are left blank or non-reflective. Since card 72 represents the 22nd floor, it will have a reflector 120 in line with reflector 106 in the "2" column, a reflector 122 in line with reflector 108 in the "4" column, and a reflector 124 in line with reflector 112 in the "16" column. It will be noted that the reflectors 120, 122 and 124 are wider than the associated reflectors 106, 108 and 112, respectively of the first row, in order that the logic one signal will already be at that level when the position is strobed.

The second detector 102 includes a source 126 of electromagnetic radiation and a receiver 128 thereof, which are similar to the source 104 and receiver 106 of the first detector 100. As illustrated, sources 104 and 126 are connected to a source 130 of electrical potential, represented schematically by a battery. Source 126 provides a beam 132 of electromagnetic radiation.

When the hoistway door closes, each true strobe signal SL indicates the address signal FB is valid. The address will be loaded, one bit at a time, and stored. Instead of reading the MSB first, the indicia may be arranged to read the LSB first, as desired.

Figure 4:
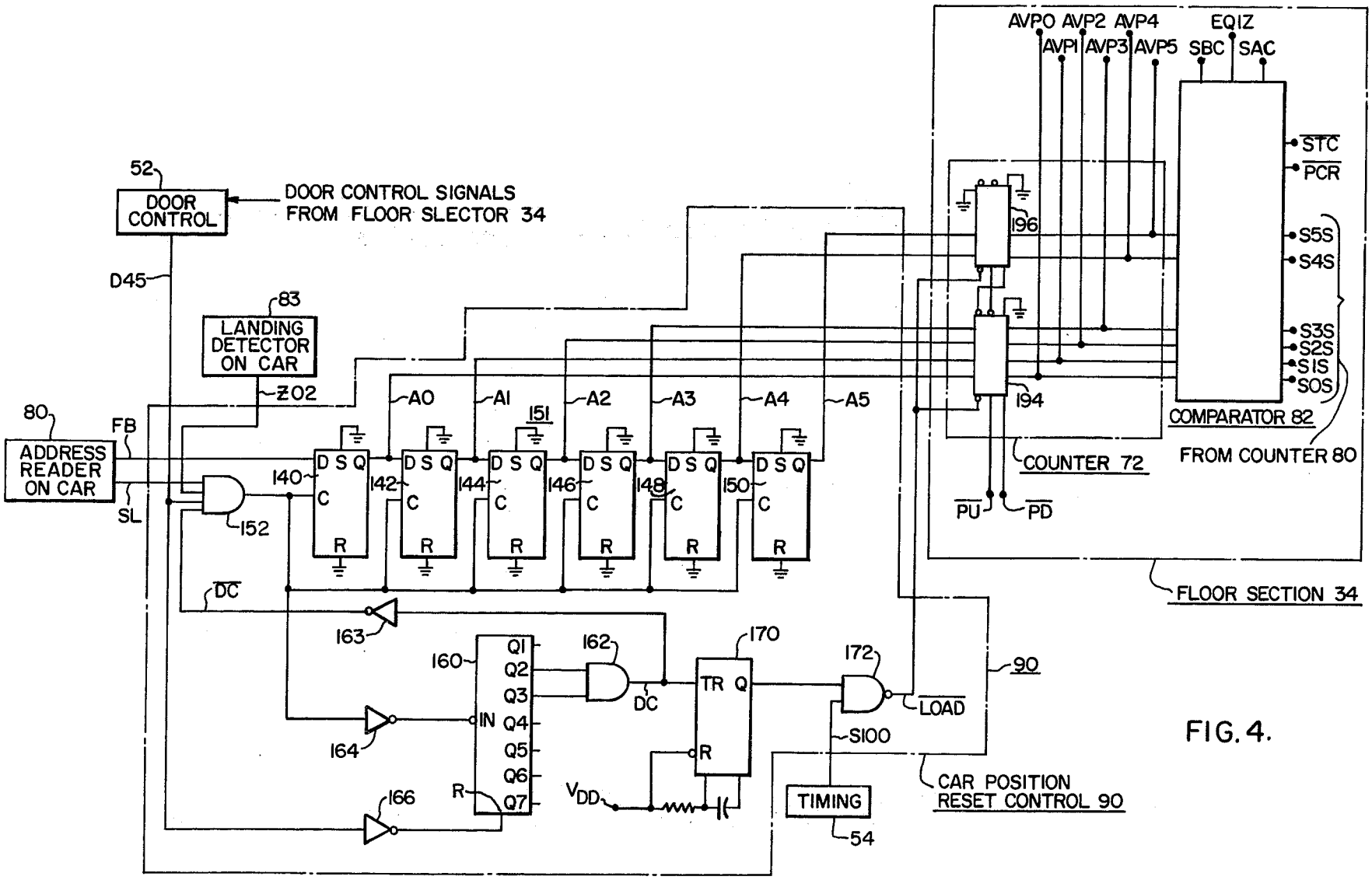
FIG. 4 is a schematic diagram which illustrates in detail circuitry which may be used to perform certain of the functions shown in block form in FIG. 1.

The car position reset control 90 may be used to replace the top and bottom reset shown in FIG. 6 of the incorporated application. FIG. 4 illustrates how FIG. 6 of the incorporated application would be modified according to the teachings of the invention. FIG. 4 also illustrates the car position reset control 90 in a detailed embodiment of the invention, which may be utilized.

More specifically, FIG. 4 illustrates a counter 72 and a comparator 82 which are part of the floor selector 34. For purposes of the present invention it is sufficient to describe counter 72, which is the memory which stores the position of the elevator car 12 in the building 14 relative to a floor position, in response to movement of the elevator car through the building. Counter 72 includes the necessary number of cascaded synchronous 4-bit binary counters required to provide floor addresses for the number of floors in the associated structure, with two counters 194 and 196 being illustrated. The count-up input of counter 194 is connected to an input terminal $\overline{PU}$, which receives an index pulse when the floor address is to be incremented due to upward movement of the elevator car, and the count-down input of counter 194 is connected to an input terminal $\overline{PD}$, which receives an index pulse when the floor address is to be decremented due to downward movement of the elevator car. The output of counter 72 is connected to output terminals AVP0, AVP1, AVP2, AVP3, AVP4, and AVP5, which provide the floor address of the elevator car at which the car is located when it is stopped. These terminals provide the floor address of the closest floor in the direction of car travel at which the elevator car can make a normal stop, when the elevator car is moving.

The present invention does not have to become involved in the "advanced car position" of a moving elevator car, since it performs all of its functions while the elevator car is standing at a floor. Also, the present invention may be used without complication by elevator systems which use an "advance notch" floor selector.

The car position reset control 90 includes a plurality of memory elements, one for storing each floor address bit, such as six D-type flip-flops 140, 142, 144, 146, 148 and 150, connected as a shift register 151. The logic level present at the D input is transferred to the Q output during the positive going transition of the clock pulse. The flip-flops 140–150 all have their clock inputs connected to the output of a four input AND gate 152. The inputs of AND gate 152 are connected to receive the strobe signals SL from the address reader 80, a car position signal Z02 from landing detector 83, which is true when the car is within 2 inches of floor level, the door close signal D45 from door control 52, which is true when the doors are signaled to close, and a signal $\overline{DC}$ which is high until all six bits of the floor address have been received. Signal $\overline{DC}$ is provided by a binary counter 160 and a dual input AND gate 162 connected to provide a high signal DC after the counter 160 has received six true pulses at its input IN, and an inverter or NOT gate 163. Input terminal IN is connected to the output of AND gate 152 via an inverter 164, and counter 160 thus counts the strobe pulses SL applied to clock inputs of the D flip-flops 140–150. The reset input R of counter 160 is connected to receive the door open signal D45 via an inverter 166.

The D input of the first flip-flop 140 of the shift register 151 is connected to receive the floor address bits FB. Thus, when the car 12 is at a floor (Z02=1) and the car doors are requested to close (D45=1), the six strobe bits will clock in the six bits FB of the floor address. Counter 160 will count to 6 and cause AND gate 162 to provide a high signal DC which is inverted to a low signal $\overline{DC}$, which prevents AND gate 152 from providing any additional pulses.

If the car door should be stopped before it is completely closed, signal D45 will go low and inverter 166 will provide a high signal to reset counter 160. The hereinbefore described procedure will then be repeated during the next attempt to close the door.

Car position reset control 90 also includes means for providing a true signal $\overline{LOAD}$ when a floor address has been completely loaded into the shift register 151. As illustrated, a monostable multivibrator 170 may be triggered by a true signal DC to provide a pulse of controlled duration to one input of a dual input NAND gate 172. This high input is strobed to the jam inputs of counter 72 via a strobe signal S100 from system timing circuitry 54, which provides a low or true signal $\overline{LOAD}$ at the output of NAND gate 172 for the duration of strobe pulse S100.

The D flip-flops 140–150, counter 160 and monostable multivibrator 170 may be provided by RCA's CD 4013, CD 4024, and CD 4098, respectively, by way of example.

In summary, there has been disclosed a new and improved elevator system which can reset the floor selector merely by opening and closing its doors. The door movement scans a coded address past a pair of readers, which loads the floor address bit by bit into a shift register. The shift register is then loaded into the car position counter and the elevator system is ready for operation. This procedure may be automatically followed at each floor location during the normal operation of the elevator system, to insure that the floor selector is always in step with the actual car position.

We claim as our invention:

1. An elevator system, comprising:

a building having a plurality of floors, a hoistway, and openings from the floors to the hoistway, hoistway doors at the floors operable between open and closed positions to open and close the openings to the hoistway, an elevator car mounted for movement in the hoistway to serve the floors, control means for controlling the operation of said elevator car, including memory means responsive to movement of said elevator car for storing the position of the elevator car in the building relative to a floor position, address means, including address indicia mounted on at least one of said hoistway doors for movement therewith, and reading means on said elevator car for reading said address indicia during movement of said at least one hoistway door, said memory means being additionally responsive to said reading means.

2. The elevator system of claim 1 wherein the address means includes address indicia mounted on each hoistway door.

3. The elevator system of claim 1 wherein the address indicia defines the binary address of the floor associated with the at least one hoistway door.

4. The elevator system of claim 1 wherein the address means includes strobe indicia which indicates when each bit of the address indicia should be read by the reading means, and the reading means includes first detector means for detecting the strobe indicia, and second detector means for detecting the address indicia.

5. The elevator system of claim 1 wherein the memory means is a counter, the reading means includes detector means for detecting the address indicia, and storage means for storing the address detected by said detector means, and including means setting the count of said counter to the address stored in said storage means, following each reading of the address indicia by the reading means.

6. The elevator system of claim 1 wherein the address indicia includes reflectors of electromagnetic radiation, and the reading means includes a source of electromagnetic radiation and a receiver thereof, with said reflectors of electromagnetic radiation being positioned to reflect the electromagnetic radiation from said source to said receiver thereof as the hoistway door moves from one of its positions to the other.

7. The elevator system of claim 1 wherein the elevator car includes door means mounted for rectilinear motion between open and closed positions, the hoistway doors are mounted for rectilinear motion between open and closed positions, and the elevator car door means, when the elevator car is at a floor, operate the associated hoistway door between its open and closed positions, with the reading means reading the address indicia on the hoistway door during the closing movement thereof.

* * * * *